US006294968B1

(12) United States Patent
Ito et al.

(10) Patent No.: US 6,294,968 B1
(45) Date of Patent: Sep. 25, 2001

(54) DIELECTRIC FILTER AND PROCESS FOR PRODUCING SAME

(75) Inventors: Atsushi Ito, Ena; Satoru Ota, Hirakata, both of (JP)

(73) Assignees: Sanyo Electric Co., Ltd, Moriguchi; Sanyo Electronic Components Co., Ltd., Daito, both of (JP)

( * ) Notice: Subject to any disclaimer, the term of this patent is extended or adjusted under 35 U.S.C. 154(b) by 0 days.

(21) Appl. No.: 09/658,988

(22) Filed: Sep. 11, 2000

Related U.S. Application Data

(62) Division of application No. 09/207,677, filed on Dec. 9, 1998.

(30) Foreign Application Priority Data

Dec. 11, 1997 (JP) ..... 9-340891
Feb. 23, 1998 (JP) ..... 10-40535

(51) Int. Cl.[7] ..... H01P 1/20; H01P 7/04
(52) U.S. Cl. ..... 333/202; 333/206; 333/222
(58) Field of Search ..... 333/202, 203, 333/206, 207, 222, 223

(56) References Cited

U.S. PATENT DOCUMENTS 5,160,905 * 11/1992 Hoang ..... 333/204
5,345,202 * 9/1994 Kobayashi et al. ..... 333/206
5,365,209 * 11/1994 Ito et al. ..... 333/206
5,588,198 12/1996 Kawahata et al. ..... 29/600
5,977,848 * 11/1999 Nakaguchi et al. ..... 333/206
6,000,120 12/1999 Arledge et al. ..... 29/600
6,002,307 * 12/1999 Arakawa ..... 333/135

* cited by examiner

*Primary Examiner*—Robert Pascal
*Assistant Examiner*—Patricia T. Nguyen
(74) *Attorney, Agent, or Firm*—Armstrong, Westerman, Hattori, McLeland & Naughton, LLP

(57) ABSTRACT

A dielectric filter including at least three coaxial dielectric resonators of predetermined size which are bonded as arranged side by side. The resonators serving respectively as an input stage and an output stage are each formed with an external connection electrode positioned on the peripheral surface other than the adjoining surface in proximity to an exposed end face and insulated from an outer conductor layer. An inner conductor layer of the resonator serving as an intermediate stage is removed over only a suitable region from an exposed end face thereof so as to approximately match the resonance frequency of the intermediate-stage resonator to the resonance frequency of the input-stage and the output-stage resonators. The dielectric filter may include at least three coaxial dielectric resonators which are bonded as arranged side by side. An interstage coupling window is formed in each of the adjoining surfaces of the adjacent resonators, approximately at an axial midportion thereof by removing an outer conductor layer. An external connection electrode, insulated from the layer, is formed on each of the resonators serving as an input stage and an output stage approximately at an axial midportion of the outer peripheral surface other than the adjoining surface.

9 Claims, 9 Drawing Sheets

DIELECTRIC FILTER AND PROCESS FOR PRODUCING SAME

This application is a division of prior application Ser. No. 09/207,677 filed Dec. 9, 1998.

FIELD OF THE INVENTION

The present invention relates to dielectric filters chiefly for use with high-frequency signals of hundreds of megahertz to a few gigahertz.

DESCRIPTION OF THE RELATED ART

Various high-frequency filters are used in communications devices. Compactness and improved electrical characteristics are required of filters with prevalent use of cellular or portable telephones and like mobile communications devices. The conventional filters for use at high frequencies include dielectric filters comprising coaxial dielectric resonators as disclosed, for example, in JP-A-283904/1994. The dielectric filter is of the surface mount type which is mountable directly on the surface of a circuit board so as to be compacted.

FIG. 12 is an exploded perspective view showing the dielectric filter of the surface mount type. The filter comprises a plurality of (two in the illustration) coaxial dielectric resonators 100 arranged side by side in contact with each other on a base 7.

FIG. 13 is a perspective view showing the coaxial dielectric resonator 100. The resonator 100 comprises a dielectric body 2 made of a dielectric material and formed with a through-bore 22 extending through opposite end faces 20, 21 of the body 2. An outer conductor layer 30, an inner conductor layer 31 and an end conductor layer 32 arc provided respectively on the outer peripheral surface of the dielectric body 2, the inner surface of the body defining the bore 22 and one of the end faces, 21, of the body 2. As shown in FIGS. 12 and 13, the resonator 100 has a bottom surface 23 formed by partly removing the outer conductor layer 30. The adjoining surfaces of the adjacent resonators 100, 100 arc locally removed to form interstage coupling windows 10, 10. In the case of the surface mount type, the resonator 100 is generally in the form of a rectangular parallelepiped so as to be mounted on the base 7 with case.

As shown in FIG. 12, the base 7 has strip lines 81, 81 for external connection and a grounding pattern 80 which are formed on the upper surface of a dielectric base plate 70. Each of the strip lines 81 on the upper surface of the base plate 70 extends from an inward region of the plate surface to be in contact with the bottom surface 23 of the resonator 100 to the region of the plate surface to be in contact with the exposed end face 20 of the resonator 100. The grounding pattern 80 is formed on the upper surface of the base plate 70 except inward regions of the plate surface to be contact with the bottom surfaces 23, 23 of the resonators 100, 100 and the regions thereof around the strip lines 81, 81.

The resonators 100, 100 and the base 7 thus constructed are so arranged that the resonators 100, 100 are adjacent to each other and positioned in place on the base 7. In this arrangement, the resonators 100, 100 are electromagnetically coupled to each other through the interstage coupling windows 10, 10, and the strip lines 81, 81 are capacitance-coupled respectively to the inner conductor layers 31, 31 of the resonators 100, 100, whereby a band-pass filter is provided.

While the filter of FIG. 12 comprises two coaxial dielectric resonators 100, 100, at least one coaxial dielectric resonator formed with interstage coupling windows 10, 10 in opposite side surfaces thereof can be disposed between the two resonators 100, 100 adjacent thereto. Generally, the greater the number of resonators joined, the greater is the attenuation of output electric power of signals at the boundary between the pass band and the outside thereof.

To ensure matching between the adjoining resonators 100, 100 of the surface mount dielectric filter thus constructed, the exposed end face 20 of each resonator 100 is adjusted by trimming to obtain a complete product. The completed filter is mounted on a circuit board, with the rear surface of the base in contact with the surface of the circuit board.

To fulfill the requirement that the surface mount dielectric filter be made more compact, it is desired to mount the coaxial resonators only on the circuit board with the base 7 omitted.

In this case, there arises a need to bond the adjacent resonators to each other. However, coaxial dielectric resonators for use with high-frequency signals have a very small axial length of several millimeters and are therefore difficult to bond as positioned properly.

Furthermore, the coaxial dielectric resonators serving respectively as an input stage and an output stage must be provided with external connection electrodes as separated from the outer conductor layers of the resonators, in place of the strip lines 81, 81 on the base 7. Generally these electrodes are formed near the exposed end faces of the respective resonators so as to be coupled strongly with their inner conductor layers. The resonators serving as the input stage and the output stage are then substantially shortened in resonance wavelength and become higher in resonance frequency. In the case of the dielectric filter comprising at least three adjacent coaxial dielectric resonators of the same size, the input-stage and output-stage resonators then have a resonance frequency higher than, and failing to match, that of the intermediate-stage resonator, resulting in impaired filter characteristics.

An approximate match in resonance frequency can be obtained by making the intermediate-stage resonator smaller than the other resonators in axial length, whereas the different axial lengths of the resonators result in difficulty in bonding the adjacent resonators in position.

SUMMARY OF THE INVENTION

An object of the present invention is to provide a dielectric filter comprising adjacent coaxial dielectric resonators which can be bonded to one another as readily positioned in place, and a process for producing the filter.

Another object of the invention is to provide a dielectric filter which comprises at least three coaxial dielectric resonators having the same axial length and in which the resonance frequency of the input-stage and output-stage resonators can be approximately matched to that of the intermediate-stage resonator, and a process for producing the filter.

To accomplish these objects, the present invention provides a process for producing a dielectric filter comprising a plurality of coaxial dielectric resonators as arranged side-by-side in contact with one another, the process including the steps of preparing the coaxial dielectric resonators each comprising a dielectric body made of a dielectric material and having a through bore extending through opposite end faces thereof, the dielectric body being provided with an outer conductor layer and an inner conductor layer respectively on an outer peripheral surface thereof and an inner surface thereof defining the bore; forming interstage coupling windows by removing the outer conductor layer from the same region of each of adjoining surfaces of the resonators to be adjacent to each other; and bonding the resonators as arranged side-by-side by applying an electrically conductive bonding material to at least one of the outer conductor layers remaining on the adjoining surfaces, placing the resonators in proximity to each other on a smooth-surfaced table and allowing the surface tension of the bonding material to draw the resonators toward each other.

When the coaxial dielectric resonators are arranged side-by-side on the smooth-surfaced table for bonding according to the invention, the surface tension of the bonding material produces between the adjacent resonators a force acting to draw them toward each other. Accordingly, when the outer conductor layers on the respective opposed adjoining surfaces are in the same region, the surface tension of the bonding material 4 exerts a force acting to draw the outer conductor layers 300, 301 of the adjoining surfaces toward each other as shown in FIG. 1B even if the portions to be bonded of the resonators 1, 1 are somewhat shifted relative to each other as shown in FIG. 1A. The resonators 1, 1 slide on the smooth-surfaced table owing to the force and become bonded as spontaneously positioned properly as seen in FIG. 2. This obviates the need to position the resonators properly relative to each other before bonding, facilitating the fabrication of the dielectric filter.

The present invention also provides a process for producing a dielectric filter comprising at least three coaxial dielectric resonators as arranged side-by-side in contact with one another, the process including the foregoing step of preparing the coaxial dielectric resonators and further including the steps of forming an external connection electrode on each of the resonators serving respectively as an input stage and an output stage, the electrode being positioned on the peripheral surface other than an adjoining surface in proximity to an exposed end face and insulated from the outer conductor layer, bonding the input-stage resonator, the resonator serving as an intermediate stage and the output-stage resonator as arranged in this order side by side, and removing the inner conductor layer of the intermediate-stage resonator over only a suitable region from an exposed end face thereof so as to approximately match the resonance frequency of the intermediate-stage resonator to the resonance frequency of the input-stage and the output-stage resonators.

Even when coaxial dielectric resonators of the same size are used, the outer conductor layer or the inner conductor layer is removed from the intermediate-stage resonator over only a suitable region from the exposed end face thereof according to the invention, whereby the resonance frequency of the intermediate-stage resonator can be matched to the resonance frequency of the input-stage and the output-stage resonators. Accordingly, the dielectric filter can be prepared from coaxial dielectric resonators of the same size only and is therefore easy to fabricate.

The present invention also provides a process for producing a dielectric filter comprising at least three coaxial dielectric resonators as arranged side-by-side in contact with one another, the process including the foregoing step of preparing the coaxial dielectric resonators and further including the steps of forming an interstage coupling window in each of adjoining surfaces of the resonators to be adjacent to each other approximately at an axial midportion thereof by removing the outer conductor layer, forming an external connection electrode on each of the resonators serving as an input stage and an output stage approximately at an axial midportion of the outer peripheral surface other than the adjoining surface, the electrode being insulated from the outer conductor layer, and bonding the input-stage resonator, the resonator serving as an intermediate stage and the output-stage resonator as arranged in this order side-by-side.

Even when coaxial dielectric resonators of the same size are used, an interstage coupling window is formed in each of adjoining surfaces of the resonators to be adjacent to each other approximately at an axial midportion thereof by removing the outer conductor layer, and an external connection electrode insulated from the outer conductor layer is formed on each of the resonators serving as an input stage and an output stage approximately at an axial midportion of the outer peripheral surface other than the adjoining surface according to the invention, whereby the resonance frequency of the intermediate-stage resonator can be matched to the resonance frequency of the input-stage and the output-stage resonators. Accordingly, the dielectric filter can be prepared from coaxial dielectric resonators of the same size only and is therefore easy to fabricate.

DETAILED DESCRIPTION OF THE INVENTION

Figure 1A:
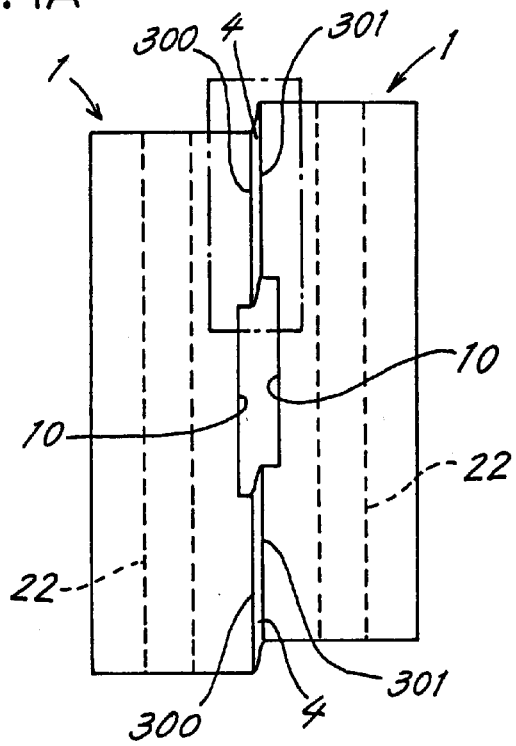
FIG. 1A is a plan view showing two coaxial dielectric resonators while they are being bonded to each other in the process of the invention for producing a dielectric filter of the surface mount type.

The present invention will be described with reference to the following embodiments.

First Embodiment

FIGS. 3A, 3B, 4A and 4B show a surface mount dielectric filter according to a first embodiment. The filter comprises three coaxial dielectric resonators 1*a*, 1*b*, 1*c* of the same size joined as arranged side by side in proximity to one another.

Each of the resonators 1*a*, 1*b*, 1*c* is a quarter-wavelength resonator comprising a dielectric body 2 made of a dielectric material in the form of a prism, having a through bore 22 extending through opposite end faces 20, 21 of the body 2, and coated with an electrically conductive material over the outer peripheral surface of the body 2, the inner surface of the body 2 defining the bore 22 and one of the end faces, 21, of the body 2 to form an outer conductor layer 30, inner conductor layer 31 and end conductor layer 32, respectively. Interstage coupling windows 10, 10 are formed in the adjacent resonators 1, 1, each approximately at an axial midportion thereof by removing the outer conductor layer 30 from the same region of each of the opposed adjoining surfaces.

Figure 3A:
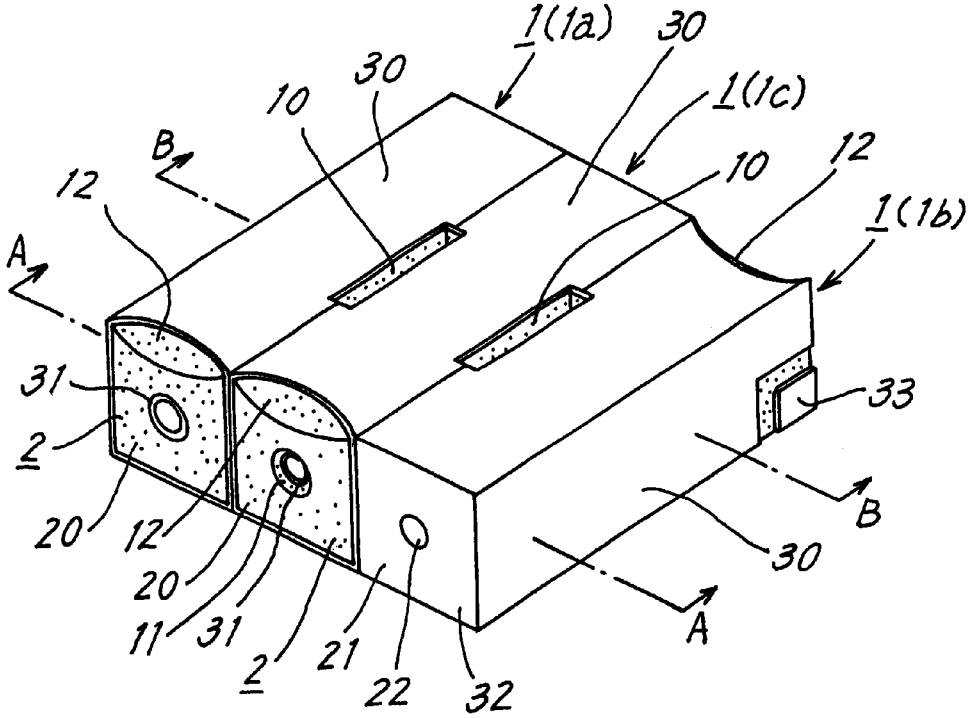
FIG. 3A is a perspective view showing a dielectric filter as a first embodiment of the invention.
Figure 3B:
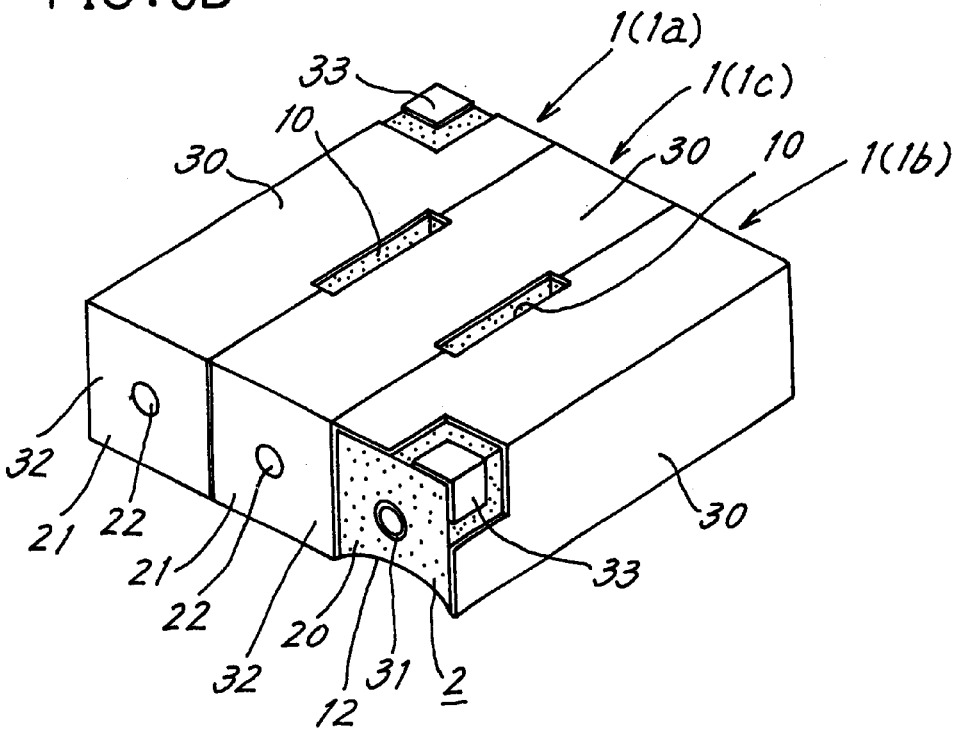
FIG. 3B is a perspective view showing the embodiment of FIG. 3A as turned upside down.
Figure 4A:
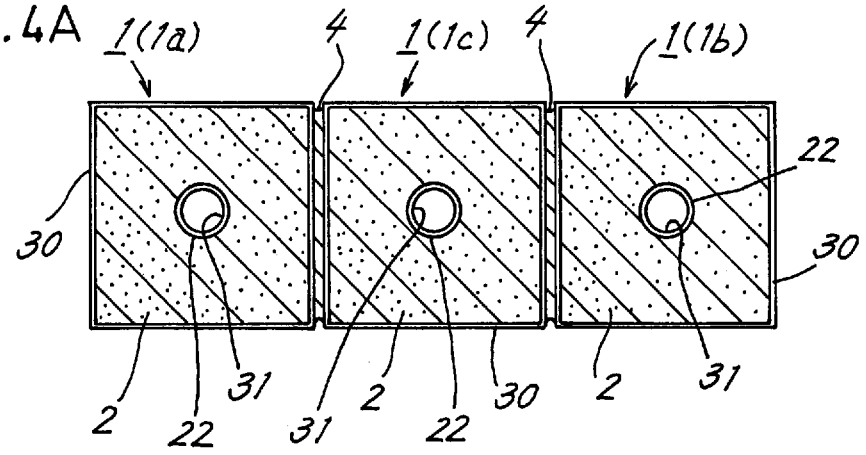
FIG. 4A is a view in vertical section taken along the line A—A in FIG. 3A and showing the embodiment as it is seen in the direction of the arrows.
Figure 4B:
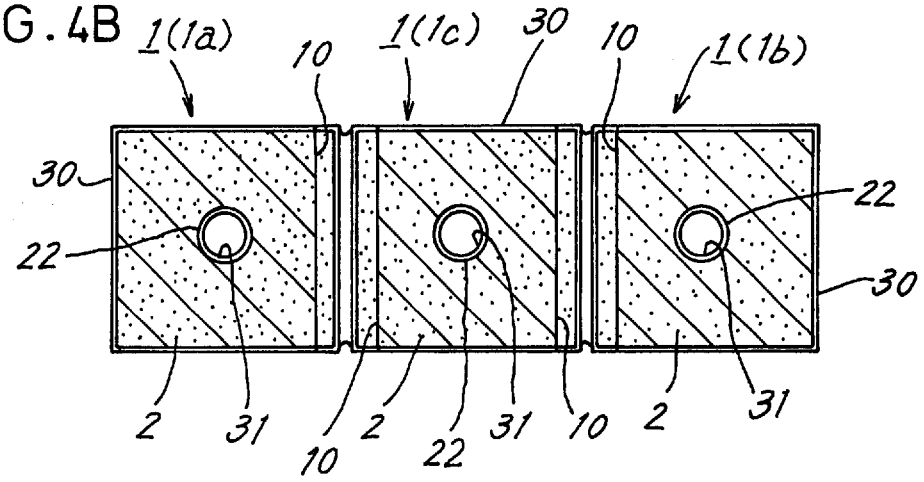
FIG. 4B is a view in vertical section taken along the line B—B in FIG. 3A and showing the embodiment as it is seen in the direction of the arrows.

As shown in FIG. 3B, each of the resonators 1*a*, 1*b* serving as an input stage and an output stage has an external connection electrode 33 insulated from the outer conductor layer 30 and formed by removing a side to bottom portion of the outer conductor layer 30 in the vicinity of the exposed end face 20. The resonator 1*c* serving as an intermediate stage has an opening edge cut portion 11 formed by partly removing the inner conductor layer 31 around the through bore 22 in the exposed end face 20 so as to approximately match the resonator lc to the input-stage and output-stage resonators 1*a*, 1*b* in resonance frequency.

Each resonator 1 has an outer edge cut portion 12 formed by removing the outer conductor layer 30 from the outer edge portion of the exposed end face 20 so as to obtain a match between the adjacent resonators 1, 1.

Examples of suitable materials for the dielectric body 2 are ceramics having a high dielectric constant, such as barium oxide, titanium oxide and neodymium oxide. Examples of suitable electrically conductive materials for the outer conductor layer 30, the inner conductor layer 31, etc. are those having a high conductivity, such as silver and copper.

The surface mount dielectric filter of the construction described above is produced by the procedure to be described next.

First, three coaxial dielectric resonators 1 of predetermined size are prepared each by forming a through bore 22 in a dielectric body 2 in the form of a prism and thereafter forming an outer conductor layer 30, inner conductor layer 31 and end conductor layer 32. Next, the outer conductor layer 30 and the dielectric body 2 are partly removed from each of the resonators 1*a*, 1*b* serving as an input stage and an output stage to form an external connection electrode 33 and an interstage coupling window 10. Similarly, an interstage coupling window 10 is formed in each of opposite sides of the resonator lc serving as an intermediate stage.

Subsequently, an electrically conductive bonding material 4 is applied to the outer conductor layers 30 over the entire areas thereof providing the adjoining surfaces of the resonators 1*a*, 1*b*, 1*c*, and the resonators 1*a*, 1*b*, 1*c* are thereafter arranged side by side in proximity to one another on a smooth-surfaced table.

Figure 1B:
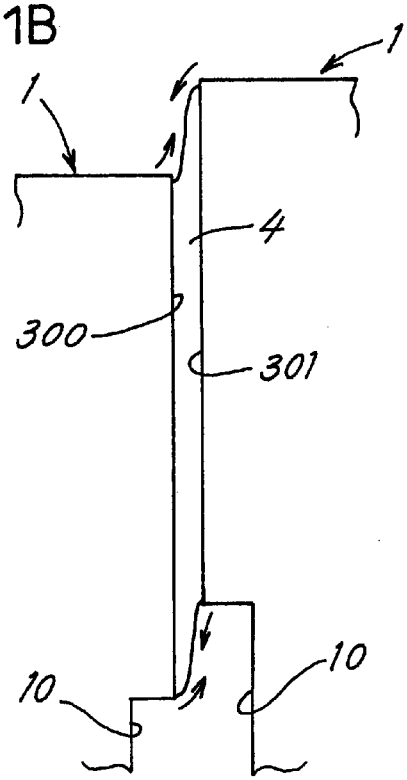
FIG. 1B is an enlarged view showing the portion surrounded by a chain line in FIG. 1A.
Figure 2:
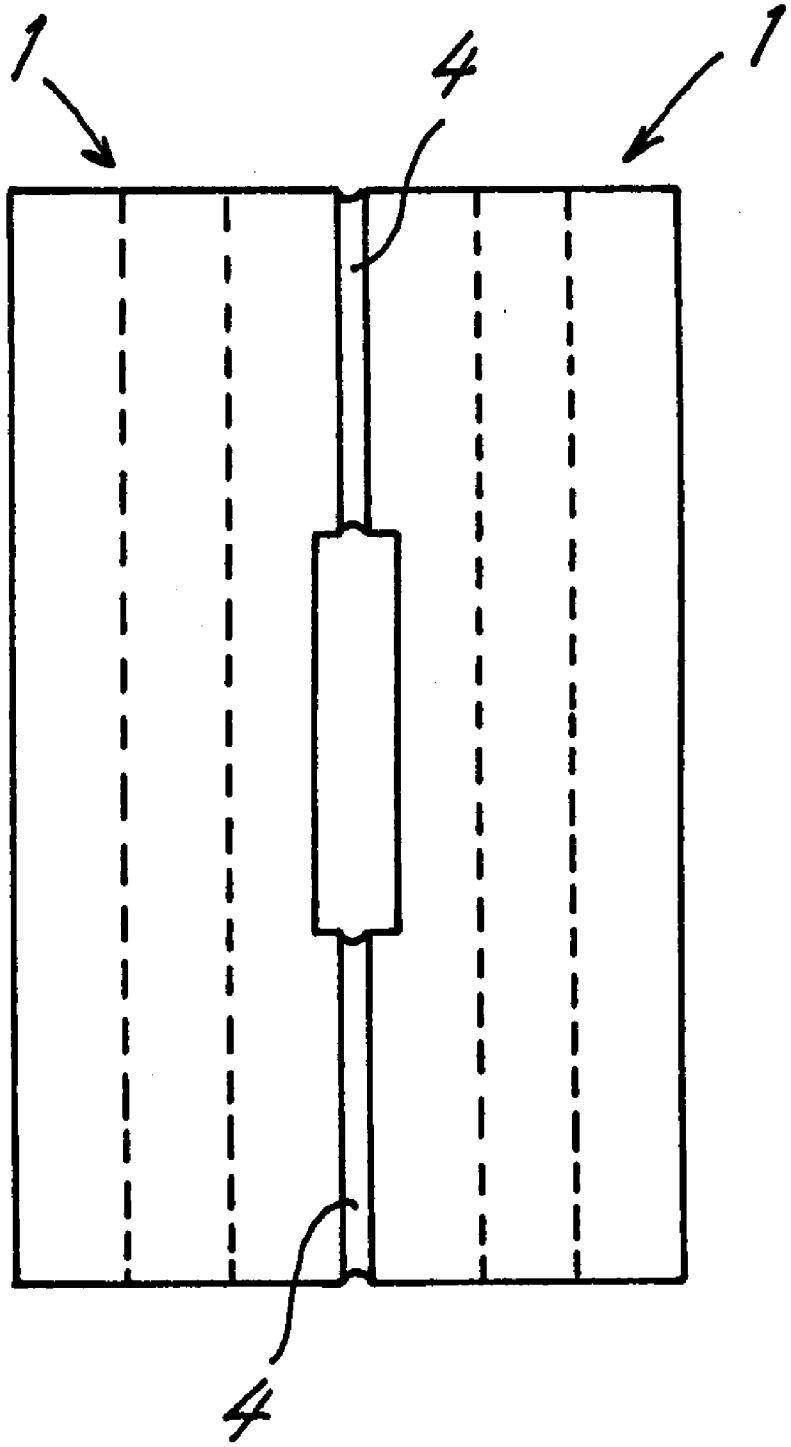
FIG. 2 is a plan view showing the resonators as bonded to each other in the process.

Even if the portions to be bonded of the adjacent resonators 1, 1 are somewhat shifted relative to each other as shown in FIG. 1A, the surface tension of the bonding material 4 then exerts a force acting to draw the outer conductor layers 300, 301 of the adjoining surfaces toward each other at edges portions of the layers as shown in FIG. 1B, permitting the resonators 1, 1 to slide on the smooth-surfaced table owing to the force to become bonded as spontaneously positioned properly as seen in FIG. 2.

It is desired that the conductive bonding material 4 to be used be solder in view of the bond strength. Further it is desirable to use high-temperature solder having a high melting point so that the solder retains the bond strength even when the temperature rises when the filter is mounted or operated. In the case where solder is used as the bonding material 4, it is desired to heat the resonators 1*a*, 1*b*, 1*c* as arranged side by side in contact with one another on the smooth-surfaced table.

Figure 5:
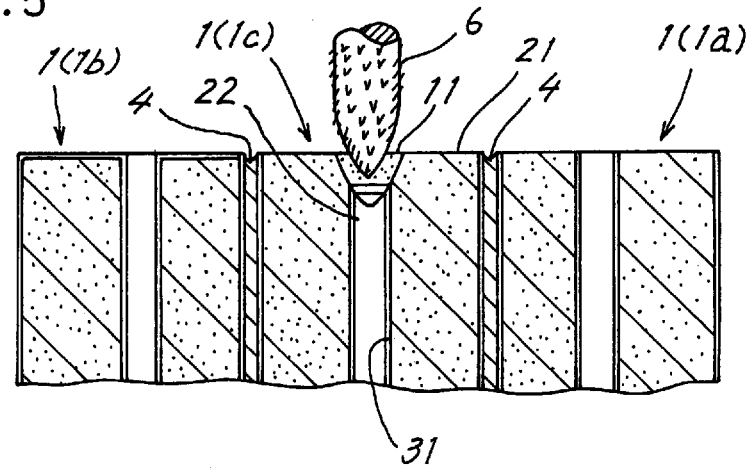
FIG. 5 is a fragmentary view in cross section of the first embodiment to show the step of removing an inner conductor layer of an intermediate-stage coaxial dielectric resonator from an exposed end face thereof.

Next as seen in FIG. 5, a diamond tool 6 is inserted into the bore 22 of the intermediate-stage resonator 1*c* from the exposed end face 20 thereof to partly remove the inner conductor layer 31 and the dielectric body 2 in the vicinity of the exposed end face 20 to form an opening edge cut portion 11 to make the resonance frequency of the intermediate-stage resonator 1*c* approximate to that of the input-stage and output-stage resonators 1*a*, 1*b*.

A reamer may be used in place of the diamond tool 6 to remove the inner conductor layer 31 only in the vicinity of the exposed end face 20.

With the dielectric filter of the present embodiment, the inner conductor layer 31 of the intermediate-stage resonator 1*c* is removed over a suitable region from the exposed end face 20, whereby the resonance frequency of the resonator 1*c* can be made approximate to that of the input-stage and output stage resonators 1*a*, 1*b*. This makes it possible to use the coaxial dielectric resonators 1*a*, 1*b*, 1*c* of the same size, ensuring facilitated fabrication of the dielectric filter of the surface mount type.

Furthermore, the resonators 1 need not be positioned properly when to be bonded to one another, and can therefore be assembled into the surface mount dielectric filter with ease.

Figure 6:
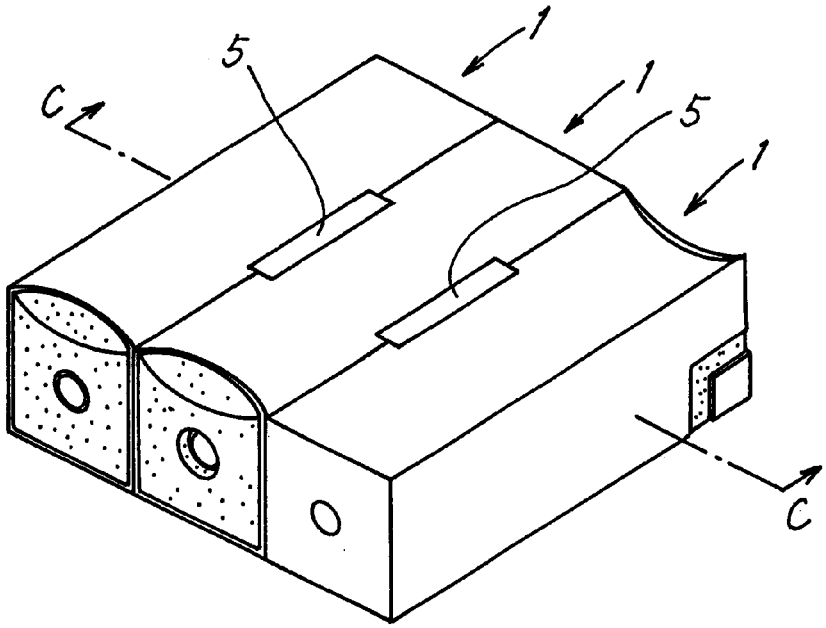
FIG. 6 is a perspective view showing interstage coupling windows of the first embodiment with an insulating adhesive applied to the windows.
Figure 7:
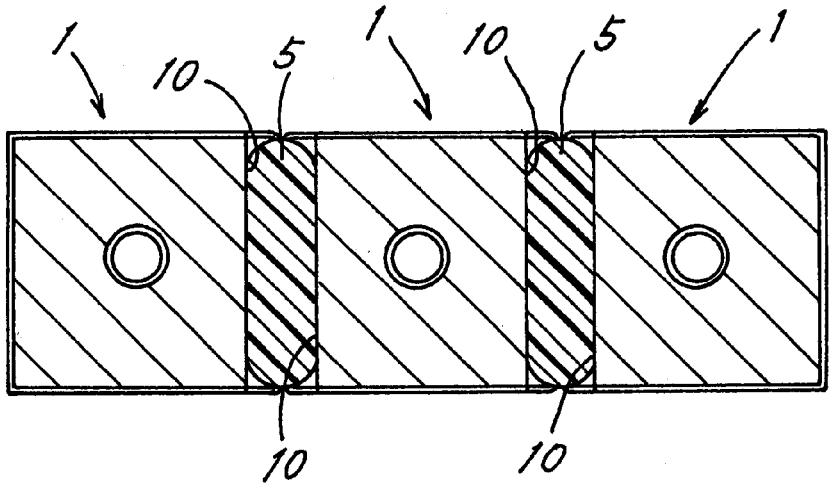
FIG. 7 is a view in vertical section taken along the line C—C in FIG. 6 and showing the embodiment as it is seen in the direction of the arrows.

When an insulating adhesive material 5 is provided in the interstage coupling windows 10, 10 between the adjacent resonators 1, 1 as shown in FIGS. 6 and 7, an enhanced bond strength can be given to the adjacent resonators 1, 1. Epoxy resin or like thermosetting resin is desirable as the insulating adhesive material 5.

The coaxial dielectric resonators 1*a*, 1*b*, 1*c* can be oriented in a direction as determined optionally. However, if the resonators are arranged according to the present embodiment, the input-stage and output-stage resonators can be of the same configuration. This ensures economy in producing the surface mount dielectric filter.

While the inner conductor layer 31 of the intermediate-stage resonator 1*c* is removed over a suitable region from the exposed end face 20 to obtain an approximate match between the resonators 1*a*, 1*b*, 1*c* in resonance frequency according to the present embodiment, the outer conductor layer 30 may be removed similarly. However, a larger amount of the layer is removed, and a longer period of time is needed for the removal when the outer conductor layer 30 is removed than when the inner conductor layer 31 is removed. Parts identification codes or like data is generally impressed on electronic parts, whereas the removal of the outer conductor layer 30 diminishes the impression area. Accordingly, the inner conductor layer 31 is more desirable to remove than the outer conductor layer 30.

Second Embodiment

Figure 8A:
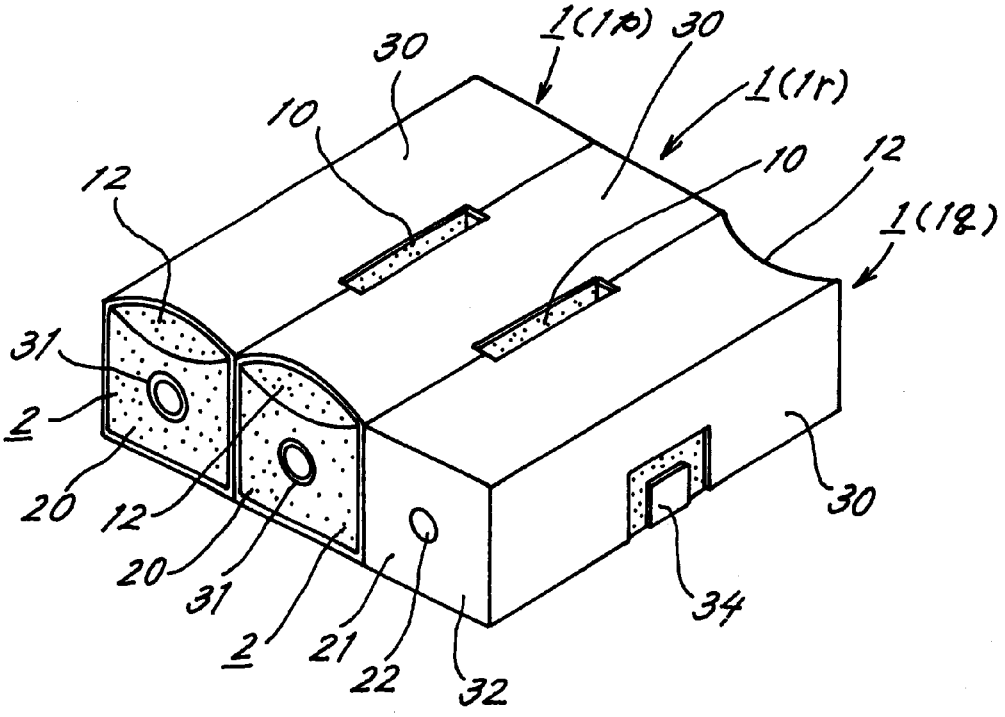
FIG. 8A is a perspective view showing a dielectric filter as a second embodiment of the invention.
Figure 8B:
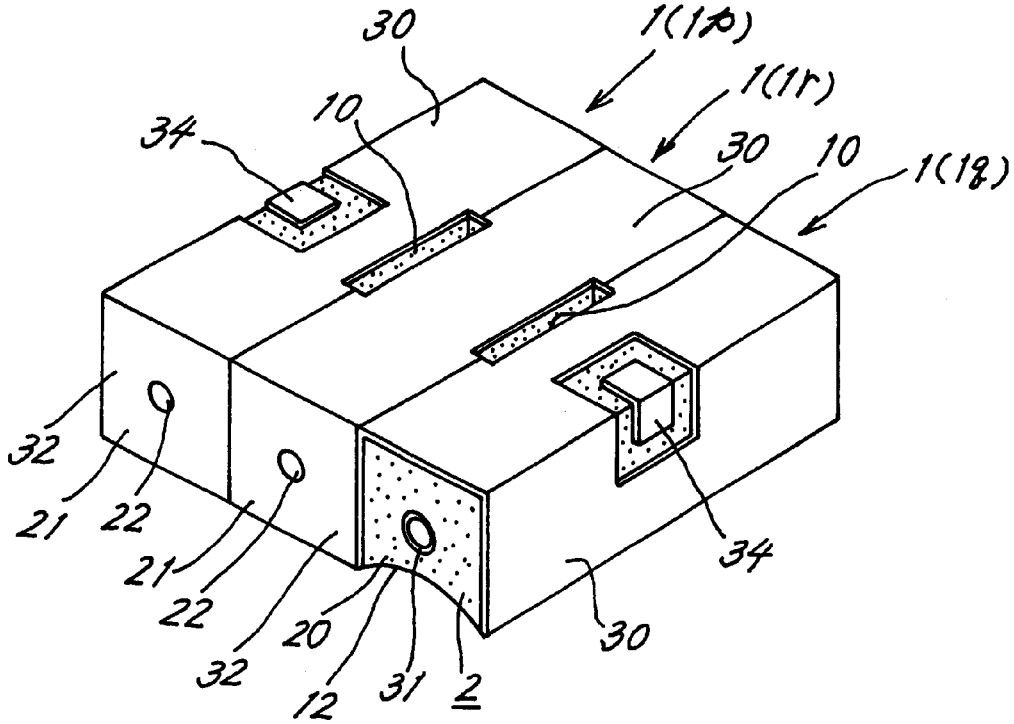
FIG. 8B is a perspective view showing the embodiment of FIG. 8A as turned upside down.

FIGS. 8A and 8B show a surface mount dielectric filter according to a second embodiment. The filter comprises three quarter-wavelength coaxial dielectric resonators 1*p*, 1*q*, 1*r* having a predetermined size and prepared in the same manner as in the first embodiment. The resonators are joined as arranged side by side in proximity to one another.

Interstage coupling windows 10, 10 are formed in the adjacent resonators 1, 1, each by removing the outer conductor layer 30 approximately at an axial midportion of the adjoining surface. Each of the resonators 1*p*, 1*q* serving as an input stage and an output stage has an external connection electrode 34 insulated from the outer conductor layer 30 and formed by removing a side to bottom portion of the outer conductor layer 30 approximately at the axial midportion of the resonator.

Each resonator 1 has an outer edge cut portion 12 formed by removing the outer conductor layer 30 from the outer edge portion of the exposed end face 20 so as to obtain a match between the adjacent resonators 1, 1.

The surface mount dielectric filter of the construction described above is produced by the procedure to be described next.

First, three coaxial dielectric resonators 1 of predetermined size are prepared in the same manner as in the first embodiment. Next, the outer conductor layer 30 and the dielectric body 2 are partly removed from each of the resonators 1*p*, 1*q* serving as an input stage and an output stage to form an external connection electrode 34 and an interstage coupling window 10. Similarly, an interstage coupling window 10 is formed in each of opposite sides of the resonator 1*r* serving as an intermediate stage.

Subsequently, high-temperature solder serving as an electrically conductive bonding material 4 is applied to the outer conductor layers 30 over the areas thereof providing the adjoining surfaces of the resonators 1*p*, 1*q*, 1*r*, and the resonators 1*p*, 1*q*, 1*r* are thereafter arranged side-by-side in contact with one another on a smooth-surfaced table and heated, whereby the resonators 1*p*, 1*q*, 1*r* are bonded as spontaneously positioned properly as in the first embodiment.

The outer edge portions of the exposed end faces 20 of the resonators 1 are then trimmed to form outer edge cut portions 12 to obtain a match between the resonators 1*p*, 1*q*, 1*r* and complete a surface mount dielectric filter.

Frequency Characteristics

Figure 9:
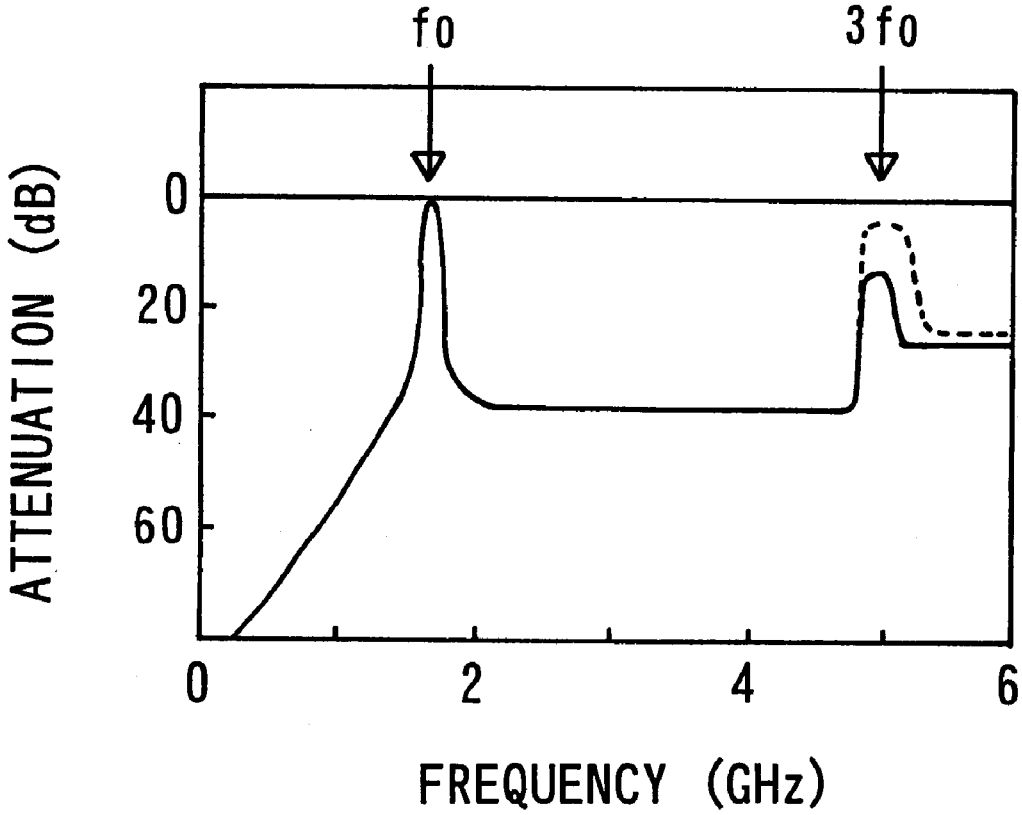
FIG. 9 is a graph showing the frequency characteristics of the dielectric filters according to the first and second embodiments.

FIG. 9 is a graph showing the frequency characteristics of the dielectric filters of the first and second embodiments. Plotted as abscissa in the graph is the frequency in GHz (gigahertz) vs. the attenuation of signals in dB (decibels) as ordinate. With the dielectric filter of the first embodiment, the characteristics are represented by a dotted line at frequencies not smaller than three times (third harmonic 3f0) the fundamental frequency f0, and by a solid line in the other frequency range. With the dielectric filter of the second embodiment, the characteristics are represented by a solid line.

FIG. 9 reveals that the filter of the second embodiment is comparable to the filter of the first embodiment in attenuation around the fundamental frequency fo providing a pass band. The filter of the second embodiment, which is not formed with the opening edge cut portion 11 in the exposed end face 20 of the intermediate-stage resonator 1*c* unlike the filter of the first embodiment (see FIG. 3A), is therefore comparable to the filter of the first embodiment in band-pass characteristics. Consequently, the filter of the second embodiment is easier to fabricate than the filter of the first embodiment.

FIG. 9 further indicates that the filter of the second embodiment is greater in attenuation than the filter of the first embodiment around the third harmonic (3f0). Accordingly, the filter of the second embodiment is superior to the filter of the first embodiment in attenuation characteristics outside the pass band.

It is thought that the three coaxial dielectric resonators 1*p*, 1*q*, 1*r* can be in three kinds of arrangements with respect to orientation as described below.

Figure 10A:
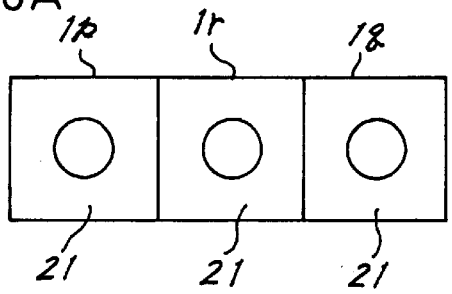
FIG. 10A is a front view showing a combination of coaxial dielectric resonators as oriented in one direction to provide a dielectric filter of the second embodiment.

(i) All the resonators 1*p*, 1*q*, 1*r* are so arranged that the short-circuited end faces 21 each having the end conductor layer 32 are oriented in the same direction (FIG. 10A).

Figure 10B:
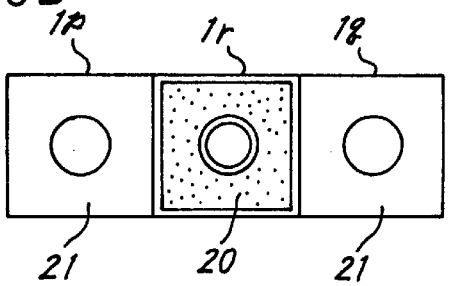
FIG. 10B is a front view showing a combination of coaxial dielectric resonators as oriented in different directions to provide a dielectric filter of the second embodiment.

(ii) The input-stage and output-stage resonators 1*p*, 1*q* are arranged with the short-circuited end faces 21 oriented in one direction, with the short-circuited end face 21 of the intermediate-stage resonator 1*c* oriented in the opposite direction (FIG. 10B).

Figure 10C:
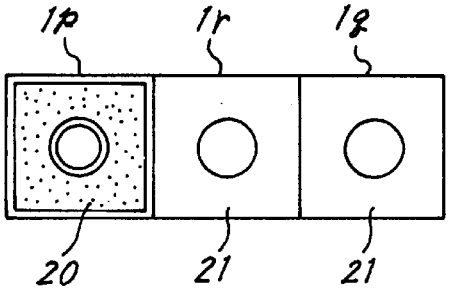
FIG. 10C is a front view showing another combination of coaxial dielectric resonators as oriented in different directions to provide a dielectric filter of the second embodiment.

(iii) The input-stage and output-stage resonators 1*p*, 1*q* are arranged with their short-circuited end faces 21 oriented in directions opposite to each other (FIG. 10C).

Figure 11:
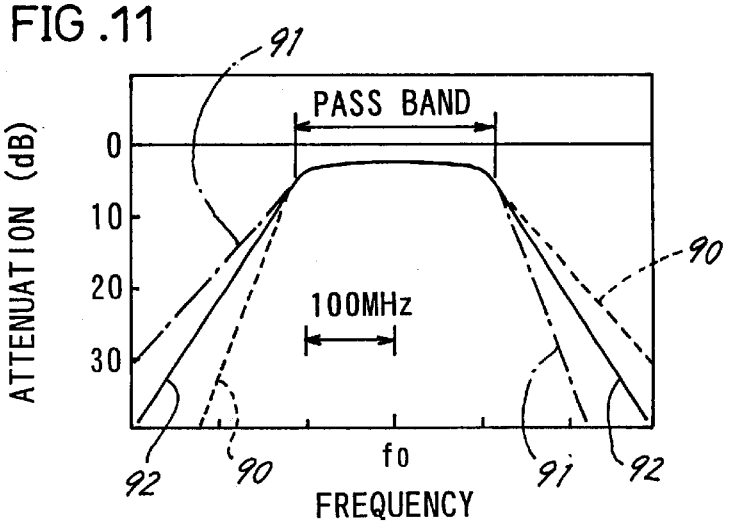
FIG. 11 is a diagram showing frequency characteristics of the dielectric filters of FIGS. 10A, 10B and 10C.
Figure 12:
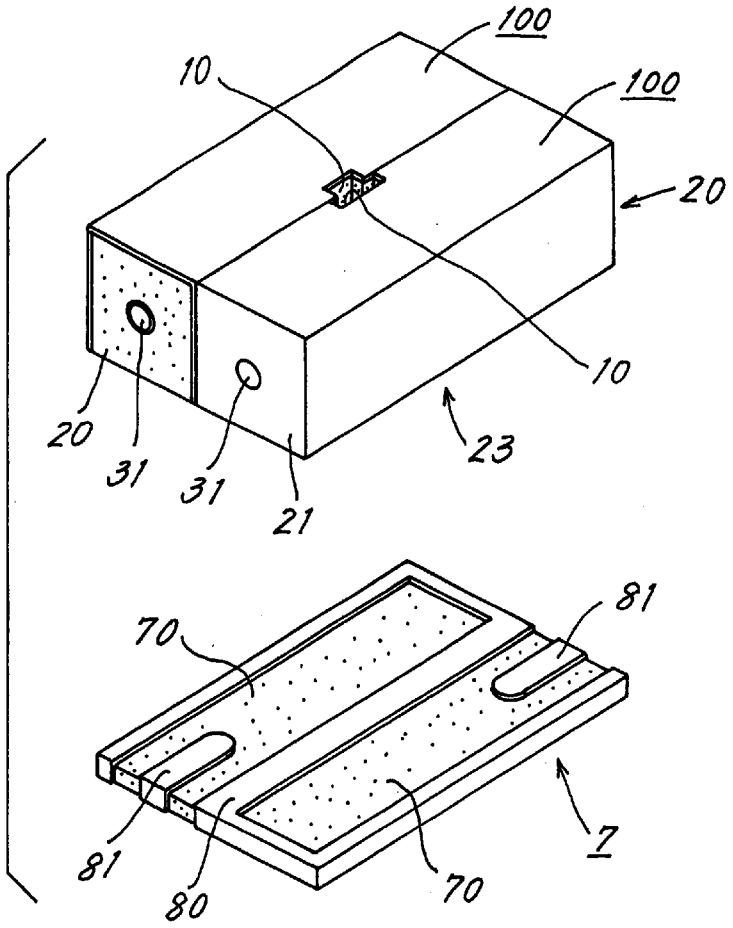
FIG. 12 PRIOR ART
FIG. 12 is an exploded perspective view showing a conventional dielectric filter of the surface mount type.
Figure 13:
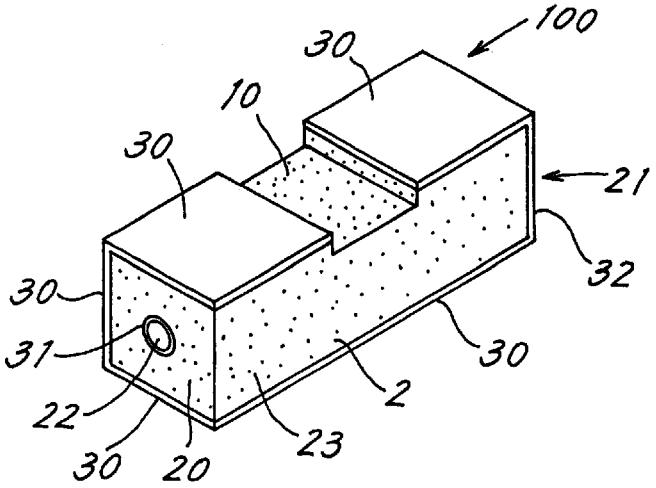
FIG. 13 PRIOR ART
FIG. 13 is a perspective view showing a coaxial dielectric resonator of FIG. 12.

Accordingly, these three kinds of dielectric filters were prepared for trial and tested for frequency characteristics to obtain the graph of FIG. 11, which corresponds to a portion of the graph of FIG. 9 as enlarged around the fundamental frequency f0 included in the pass band of signals. In FIG. 11, the frequency characteristics of the filters (i), (ii) and (iii) are represented by a dotted line 90, chain line 91 and solid line 92, respectively.

The graph of FIG. 11 reveals the following results.

In the case of (i), the resonators are capacitance-coupled too strongly, hence inferior attenuation characteristics at higher frequencies outside the pass band.

In the case of (ii), the resonators are magnetically coupled too strongly, hence inferior attenuation characteristics at lower frequencies outside the pass band.

In the case of (iii), the filter exhibits satisfactory attenuation characteristics which are balanced.

Thus, the dielectric filter having the arrangement of FIG. 10C is found preferable in which the short-circuited end faces 21 of the input-stage and output-stage resonators 1*p*, 1*q* are oriented in directions opposite to each other.

Although the first and second embodiments each comprise three coaxial dielectric resonators, another intermediate-stage resonator 1*c* or 1*r* may be additionally used. In the case of the first embodiment, it is desired that the additional intermediate-stage resonator 1*c* be similarly formed with an opening edge cut portion 11.

Although the external connection electrodes 33, 34 of the first and second embodiments are rectangular, these electrodes can be altered as desired in size or shape insofar as the desired coupling capacitance is available with the inner conductor layer 31.

Further according to the first and second embodiments, the external connection electrodes 33, 34 are each formed over two sides (i.e., lateral side and bottom side) of the outer peripheral surface in order to provide great external coupling and to form a fillet for the recognition of soldering, whereas the electrode 33 or 34 may be formed on only one side of the outer peripheral surface when these objects are not considered important.

Since the dielectric body 2 of the resonator 1 is prepared usually by press work, the edges of the outer peripheral surface thereof are each chamfered to a curved face with a radius of about 0.1 to about 0.2 micrometer. Accordingly, even when the external connection electrode 33 or 34 is formed on only one side of the outer peripheral surface, a fillet for the recognition of soldering can be formed if the electrode 33 or 34 extends to the chamfered curved face.

The foregoing description of the embodiments is intended to illustrate the present invention and should not be construed as restricting the invention set forth in the appended claims or reducing the scope thereof. The filter of the invention is not limited to the above embodiments in construction but can of course be modified variously within the technical scope defined in the claims.

What is claimed is:

1. A dielectric filter comprising a plurality of coaxial dielectric resonators, the resonators each comprising a dielectric body made of a dielectric material and having a through bore extending through opposite end faces thereof, the dielectric body being provided with an outer conductor layer and an inner conductor layer respectively on an outer peripheral surface thereof and an inner surface thereof defining the bore, the resonators being joined to one another with the outer peripheral surface of each resonator providing an adjoining surface, wherein the resonators are the same size, an interstage coupling window is formed in the same region of the adjoining surface of each of the adjacent resonators by removing the outer conductor layer, the outer conductor layers of the adjoining surfaces are joined with an electrically conductive bonding material, and an insulating adhesive material is provided in the interstage windows of the adjacent resonators.

2. A dielectric filter according to claim 1 wherein the conductive bonding material is high-temperature solder having a high melting point.

3. A dielectric filter comprising at least three coaxial dielectric resonators, the resonators each comprising a dielectric body made of a dielectric material and having a through bore extending through opposite end faces thereof, the dielectric body being provided with an outer conductor layer and an inner conductor layer respectively on an outer peripheral surface thereof and an inner surface thereof defining the bore, the resonators being joined to one another with the outer peripheral surface of each resonator providing an adjoining surface, wherein the resonators are of the same size, wherein an external connection electrode is formed on each of the resonators serving respectively as an input stage and an output stage, the electrode being positioned on the peripheral surface other than the adjoining surface in proximity to an exposed end face and insulated from the outer conductor layer, and wherein the inner conductor layer of the resonator serving as an intermediate stage is removed over only a suitable region from an exposed end face thereof so as to approximately match the resonance frequency of the intermediate-stage resonator to the resonance frequency of the input-stage and the output-stage resonators.

4. A dielectric filter according to claim 3, wherein the outer conductor layer of each of the resonators is removed over only a suitable region from the exposed end face thereof to obtain a match between the resonators.

5. A dielectric filter according to claim 3 wherein each of the resonators is a quarter-wavelength resonator provided with an end conductor layer over one of the end faces, and the short-circuited end faces of the input-stage and output-stage resonators which end faces each have the end conductor layer are oriented in directions opposite to each other axially thereof.

6. A dielectric filter comprising a plurality of coaxial dielectric resonators, the resonators each comprising a dielectric body made of a dielectric material and having a through bore extending through opposite end faces thereof the dielectric body being provided with an outer conductor layer, an inner conductor layer and an end conductor layer respectively on an outer peripheral surface thereof, an inner surface thereof defining the bore and one of the end faces thereof, the resonators being joined to one another with the outer peripheral surface of each resonator providing an adjoining surface, wherein an interstage coupling window is formed in each of adjoining surfaces of the adjacent resonators approximately at an axial midportion thereof by removing the outer conductor layer, wherein an external connection electrode is formed on each of the resonators serving as an input stage and an output stage approximately at an axial midportion of the outer peripheral surface other than the adjoining surface, the electrode being insulated from the outer conductor layer, and wherein each of the electrodes is formed over two sides of the outer peripheral surface.

7. A dielectric filter according to claim 6, wherein the short-circuited end faces of the input-stage and output-stage resonators which end faces each have the end conductor layer are oriented in directions opposite to each other axially thereof.

8. A dielectric filter comprising a plurality of coaxial dielectric resonators, the resonators each comprising a dielectric body made of a dielectric material and having a through bore extending through opposite end faces thereof, the dielectric body being provided with an outer conductor layer, an inner conductor layer and an end conductor layer respectively on an outer peripheral surface thereof, an inner surface thereof defining the bore and one of the end faces thereof, the resonators being joined to one another with the outer peripheral surface of each resonator providing an adjoining surface, wherein an interstage coupling window is formed in each of adjoining surfaces of the adjacent resonators approximately at an axial midportion thereof by removing the outer conductor layer, wherein an external connection electrode is formed on each of the resonators serving as an input stage and an output stage approximately at an axial midportion of the outer peripheral surface other than the adjoining surface, the electrode being insulated from the outer conductor layer, and wherein the outer conductor layer of each of the resonators is removed over only a suitable region from the exposed end face thereof to obtain a match between the resonators.

9. A dielectric filter according to claim 8, wherein the short-circuited end faces of the input-stage and output-stage resonators which end faces each have the end conductor layer are oriented in directions opposite to each other axially thereof.

* * * * *